US007838804B2

(12) United States Patent
Krobok

(10) Patent No.: US 7,838,804 B2
(45) Date of Patent: Nov. 23, 2010

(54) FLAT HEATING ELEMENT

(75) Inventor: Martin Krobok, Aichach (DE)

(73) Assignee: W.E.T. Automotive Systems AG, Odelzhausen (DE)

( * ) Notice: Subject to any disclaimer, the term of this patent is extended or adjusted under 35 U.S.C. 154(b) by 806 days.

(21) Appl. No.: 11/800,669

(22) Filed: May 7, 2007

(65) Prior Publication Data

US 2007/0257027 A1 Nov. 8, 2007

(30) Foreign Application Priority Data

May 8, 2006 (DE) ..... 10 2006 021 649

(51) Int. Cl.
*H05B 3/34* (2006.01)
*F28F 9/02* (2006.01)

(52) U.S. Cl. ..... 219/549; 219/528; 219/529; 219/211; 219/212; 219/552; 219/553; 219/548; 219/545; 219/202; 219/217; 165/158

(58) Field of Classification Search ..... 219/528–9, 219/211–2, 552–3, 48–9, 545, 538, 202, 219/217; 165/158
See application file for complete search history.

(56) References Cited

U.S. PATENT DOCUMENTS

| | | | | |
|---|---|---|---|---|
| 5,824,994 | A | 10/1998 | Noda et al. | |
| 7,560,670 | B2 * | 7/2009 | Lorenzen et al. | 219/528 |
| 2003/0024727 | A1 | 2/2003 | Petrenko | |
| 2007/0278210 | A1 | 12/2007 | Weiss | |
| 2007/0278214 | A1 | 12/2007 | Weiss | |

FOREIGN PATENT DOCUMENTS

| | | | |
|---|---|---|---|
| DE | 0939579 | B1 | 2/1956 |
| DE | 38 32 342 | | 7/1989 |
| DE | 4019447 | | 2/1991 |
| DE | 4020580 | A1 | 1/1992 |
| DE | 4101290 | C2 | 7/1992 |
| DE | 4124684 | A1 | 1/1993 |
| DE | 196 38 372 | | 3/1997 |
| DE | 101 12 405 | A1 | 10/2001 |

(Continued)

OTHER PUBLICATIONS

Co-pending German Application Serial No. DE 10 2004 037 410.4.

(Continued)

*Primary Examiner*—Shawntina Fuqua
(74) *Attorney, Agent, or Firm*—Dobrusin & Thennisch PC

(57) ABSTRACT

The present invention pertains to an electric heating element with at least one flat heating resistor to be arranged near a surface to be heated, and at least one electrode that serves to feed a current into the heating resistor and features at least two contact conductor strands that are, at least locally, connected to one another and to the heating resistor, at least in an elongated contacting region. The invention proposes that at least at one location along the electrode and/or the contacting region at which at least one of the contact conductor strands, at least locally, extends parallel to the direction of the electrode, and/or the contacting region, at least one additional contact conductor strand, at least locally, extends at an angle thereto.

18 Claims, 4 Drawing Sheets

FOREIGN PATENT DOCUMENTS

| | | | |
|---|---|---|---|
| DE | 698 06 636 | T | 4/2003 |
| DE | 102 06 336 | A1 | 9/2003 |
| EP | 0758 479 | B1 | 5/1998 |
| EP | 1132028 | A | 9/2001 |
| FR | 2263657 | A | 10/1975 |
| FR | 2591839 | A | 6/1987 |
| JP | 2001-217058 | A | 8/2001 |
| WO | 2005/089019 | A2 | 9/2005 |

OTHER PUBLICATIONS

International Search Report dated Sep. 30, 2005, PCT/DE2005/000389 (Published as WO2005/089019).

Co-pending U.S. Appl. No. 11/803,486, filed May 15, 2007, published as 2007-0278210.

Co-pending U.S. Appl. No. 10/598,453, filed Aug. 31, 2006, published as 2007-0278214.

* cited by examiner

FLAT HEATING ELEMENT

CLAIM OF BENEFIT OF EARLIER FILING DATE

The present application claims the benefit of the filing date of German Application Nos. DE 102006021649.0 (filed May 8, 2006) the contents of which are hereby incorporated by reference in their entirety.

TECHNICAL FIELD

The present invention pertains to flat heating elements, particularly for user-contacted heating surfaces in the passenger compartment of a vehicle, to seats, particularly for vehicles, as well as to vehicles, according to the preambles of the independent claims.

BACKGROUND OF THE INVENTION

Electric heating elements in which a flat heating resistor is electrically contacted on respectively opposite sides by contact conductors, are known from DE 4101290 C2 and from EP 0939579 B1. In order to produce as many contact points as possible between the heating resistor and the contact conductors and to stabilize the contact conductors with respect to mechanical stresses, the heating conductors are arranged at the heating resistor in an undulating or interlaced fashion. However, it was determined that certain applications require greater stability under mechanical loads than do conventional types of contact conductors.

SUMMARY OF THE INVENTION

In order to enhance the state of the art, the invention therefore proposes a heating element, a seat, and a vehicle according to the independent claims.

Other advantageous embodiments are disclosed in the dependent claims and the description.

A detailed evaluation of contact conductor strand fractures has shown that the probability of fractures is significantly higher at the extreme values of its progression, or at its peaks, than in the remaining regions. The reason for this can be seen in that they extend approximately parallel to the contacting region or to an electrode in the region of such extreme values. Consequently, a contact conductor has very little possibility of yielding to a load. A heating element according to Claim 1 avoids the zones of higher failure probability of different contact conductor strands from being arranged directly adjacent to one another. This significantly increases the probability of a fractured contact conductor strand being bridged by adjacent contact conductor strands, and thus ensures conductivity along the contacting region. It is particularly advantageous if the majority of locations that, at least locally, extend parallel to the electrode are provided with another contact conductor strand that, at least locally, extends in a non-parallel fashion. It is advantageous if at least one-half of the remaining contact conductor strands are suitable for this type of bridging, preferably at least 70%, particularly 90%.

Heating elements according to Claims 2 and 3 can be efficiently produced with respect to the manufacturing technology.

Definitions

A conductor strand is a strand in which one, several, or numerous filament-like electrical conductors extend, particularly in essentially the longitudinal direction of the strand. A conductor strand can be composed of a plurality of conductor strands. A strand is an elongated structure, the longitudinal dimensions of which exceed its cross-sectional dimensions by far. Both cross-sectional dimensions are preferably about the same. The structure preferably can be elastically bent, however, in a solid state of aggregation ("strand").

In this context, the term filament-like means that the object thus designated is composed of a short or long fiber or of a monofilament or multifilament thread ("filament-like").

The terms "essentially" and "largely" mean that a characteristic is fulfilled by more than 50%, particularly at least 70%, preferably at least 90-95%.

"Angular" in particular means an angle in excess of 0°, particularly between 5 and 85°.

"Direction of progression" refers to the direction of a tangent at a point of an object or a curve. Particularly interesting areas are the center of the body, the cross-sectional center of a cross section and the points on a bisecting line of an elongated object.

The term "synthetic" refers to any man-made material that does not occur naturally, particularly polymers and substances derived therefrom, e.g., carbon fibers.

In this context, the term "bundle" is not used only for an assembly of individual strands into an elongated arrangement of approximately circular cross section. In the following description, a bundle of heating strands refers to a plurality of heating strands that are arranged within an elongated region of at least theoretically limited space, but should be regarded as functionally and/or spatially belonging together and/or as being arranged alongside one another relative to their overall progression.

BRIEF DESCRIPTION OF THE DRAWINGS

Details of the invention are discussed below. These explanations are intended to make the invention comprehensible. However, they have only an exemplary character. Individual or several described characteristics may naturally also be omitted, modified or supplemented. It goes without saying that the characteristics of different embodiments can also be combined with one another. In these drawings.

DETAILED DESCRIPTION OF THE INVENTION

Figure 1:
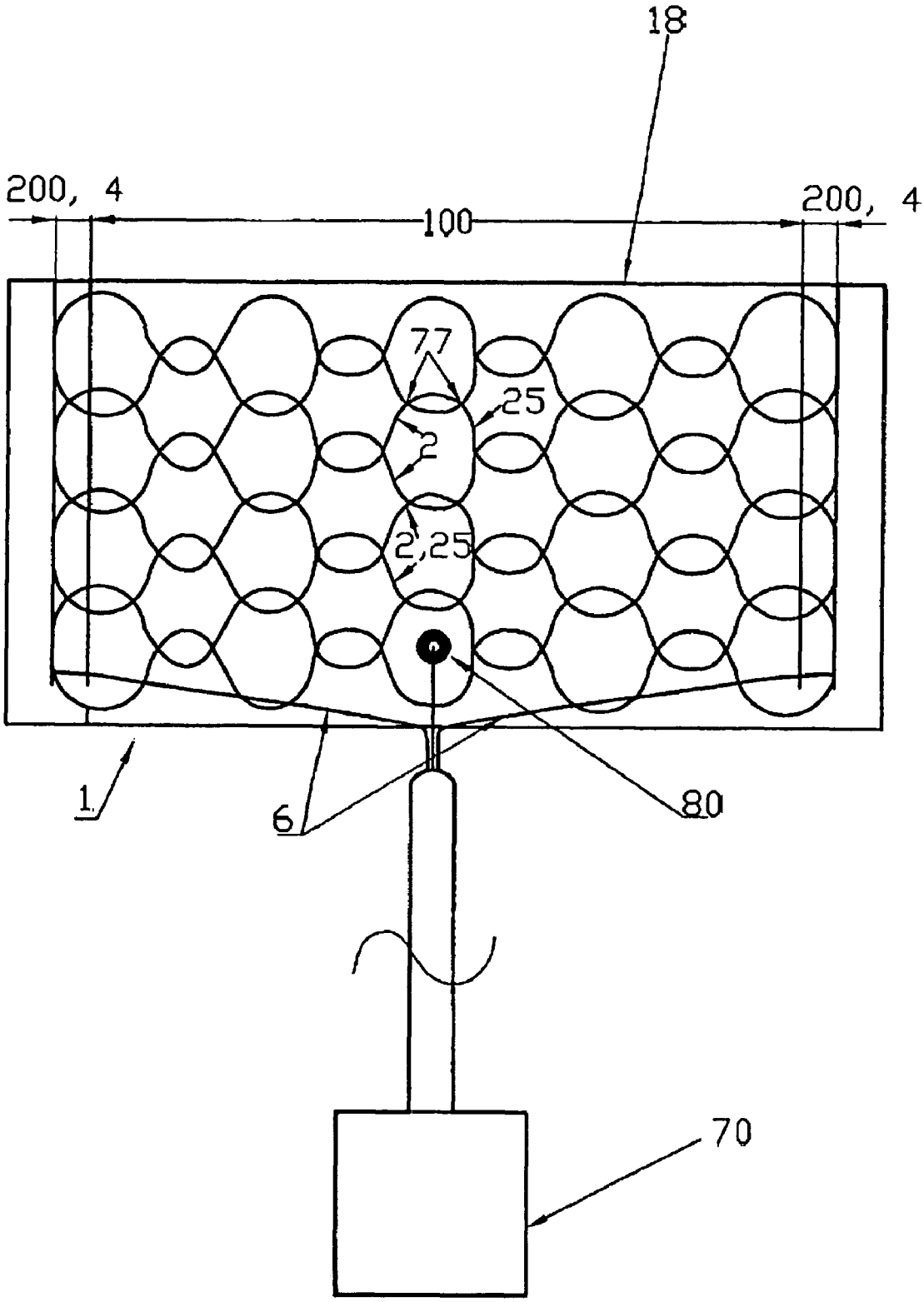
FIG. 1 shows a top view of a heating element.

FIG. 1 shows a flat electric heating element 1 ("heating element 1").

The heating element 1 features at least one flat heating resistor (18) ("heating resistor 18").

It features at least one flat carrier 8 ("flat carrier 8"). It may be appropriate for at least one of the carriers 8 to consist at least partly of a textile, knitted fabric, woven fabric, non-woven fabric, flexible thermoplastic, air-permeable material and/or foil. In the embodiment shown a carrier 8 is provided with a non-woven fabric made of man-made fibers.

According to the invention, the heating element 1 features at least one heating zone 100 ("heating zone 100"). This heating zone is associated with or forms a surface to be heated. It is largely identical to the heating resistor 18.

The heating resistor 18 features, in particular, at least one heating conductor 2 ("heating conductor 2") that is arranged on and/or in the heating zone 100. It is preferred to configure a plurality of heating conductors such that they lie adjacent to one another in a meandering fashion and are electrically arranged in parallel. In the embodiment shown, one heating conductor is arranged to an average distance of approximately 2 cm from the respectively adjacent heating conductor, and extends approximately parallel to it.

It is possible that at least some of the heating conductors 2 are networked with another such that at least part of the heating conductors 2 are contacted between their ends in an at least partly conductive fashion at contact points 77 ("interlaced heating conductors"). Local heating conductor defects that are caused, e.g., by localized damage during the sewing process or from vandalism therefore do not interfere with the operation of the heating element because the heating current is distributed to the adjacent heating conductors in the event of a local failure of individual heating conductors.

The heating element 1 features at least one contacting region 200 in which the heating zone 100 or heating resistor 18 is contacted ("contacting region 200"). The present heating element features two contacting regions 200 that are spaced apart from one another and extend approximately parallel to one another on opposite sides of the heating zone 100 such that the heating zone lies between them. However, the contacting regions may also be arranged in a curved or meandering fashion.

The heating element 1 features at least one electrode 4 for feeding a current into at least one of the heating conductors 2 of the heating resistor 18 ("electrode 4"). This embodiment is provided with two electrodes 4, each of which extends along the respective contacting region 200. Within the contacting region, they may extend in a meandering fashion and/or in a straight line as shown. They are preferably prefabricated in the form of bands, and need merely to be sewn or bonded on.

At least one electrode 4 preferably features a carrier band 14 on which at least one contact conductor strand 3, 3', 3", 3''', 3'''', 3''''' is arranged ("carrier band 14"). The carrier band 14 is preferably made of a material that provides the contact conductors 3 with a certain mobility while simultaneously protecting the contact conductors from excessive tensile or flexural stresses. Knitted or interlaced fabrics made of man-made materials known from the garment industry are particularly suitable for this purpose.

The arrangement of the contact conductor strands 3, 3', 3", 3''', 3'''', 3''''' is described in greater detail below with additional reference to FIGS. 2, 3 and 4.

Figure 2:
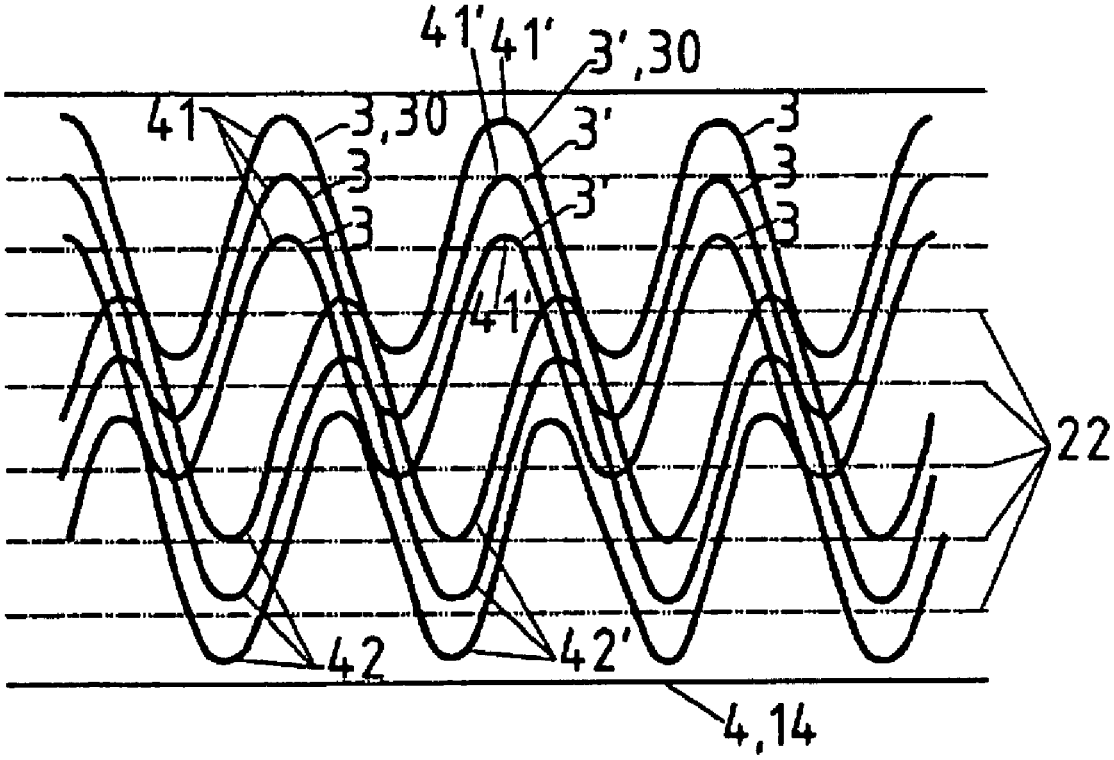
FIG. 2 shows an enlarged top view of a first embodiment of an electrode of a heating element.

FIG. 2 shows two groups of contact conductor strands 3, 3' that are respectively arranged on a carrier band 14 in the shape of a harmonic oscillation. These contact conductor strands 3, 3' are fixed on the carrier band 14 by means of a plurality of stitching lines 22 that extend parallel to one another and parallel to the electrode band [sic]. Each of the two groups of contact conductor strands 3 comprises three contact conductor strands. The contact conductor strands of each group are respectively shifted relative to one another and transverse to the carrier band 14 at regular spacings. This is why they do not contact one another in the present embodiment. However, it would also be conceivable to realize an intersecting arrangement depending on the course of the curves.

The harmonic oscillation has a sinusoidal contour ("oscillation contour"), but varying extreme values of the minima 42, 42', 42" as well the maxima 41, 41', 41" within one period (relative to the longitudinal direction of the carrier band 14).

The two groups of contact conductors 3, 3' are shifted relative to one another along the longitudinal direction of the carrier band 14 in such a way that the extreme values or peaks of the harmonic oscillations of one group of contact conductors 3 are never arranged at the same location as the extreme values or peaks of the oscillation contour of the contact conductor strands 3' of the other group relative to the longitudinal direction of the carrier band 14.

Figure 3:
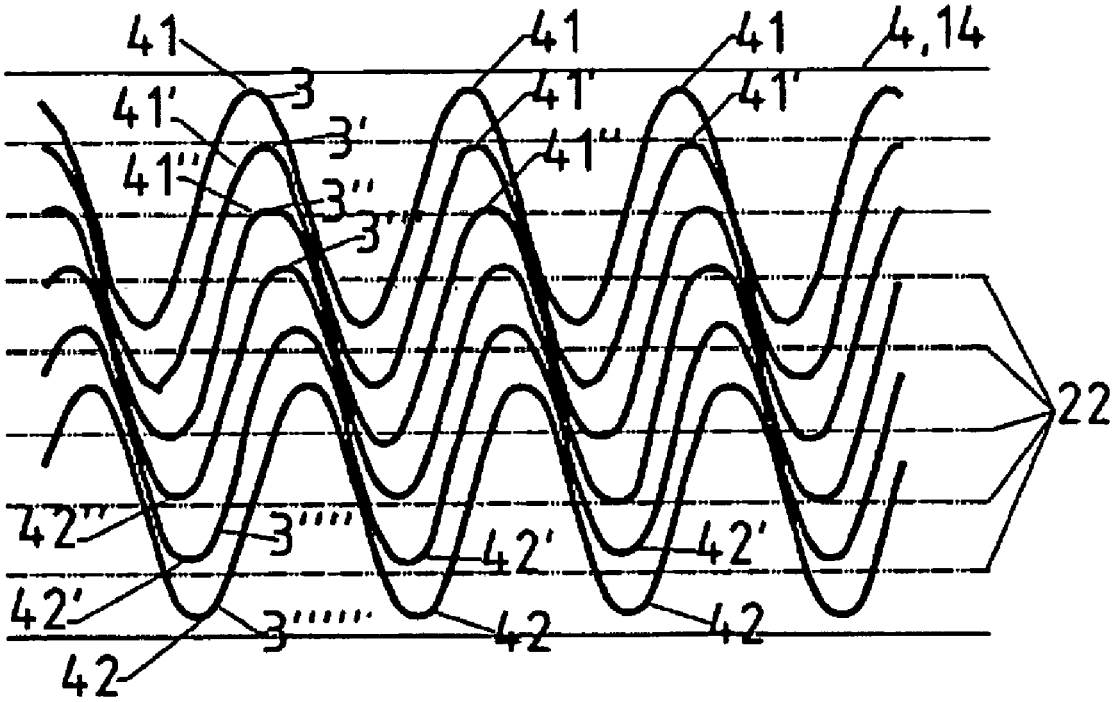
FIG. 3 shows an enlarged top view of a second embodiment of an electrode of the heating element.

In another embodiment that is illustrated in FIG. 3, the respective contact conductor strands 3, 3', 3", 3''', 3'''' 3''''' may also be slightly offset relative to all other contact conductor strands 3, 3', 3", 3''', 3'''', 3''''' along the carrier band 14. In this case, the shape of the oscillations corresponds to a sinusoidal oscillation with extreme values that always remain constant.

Figure 4:
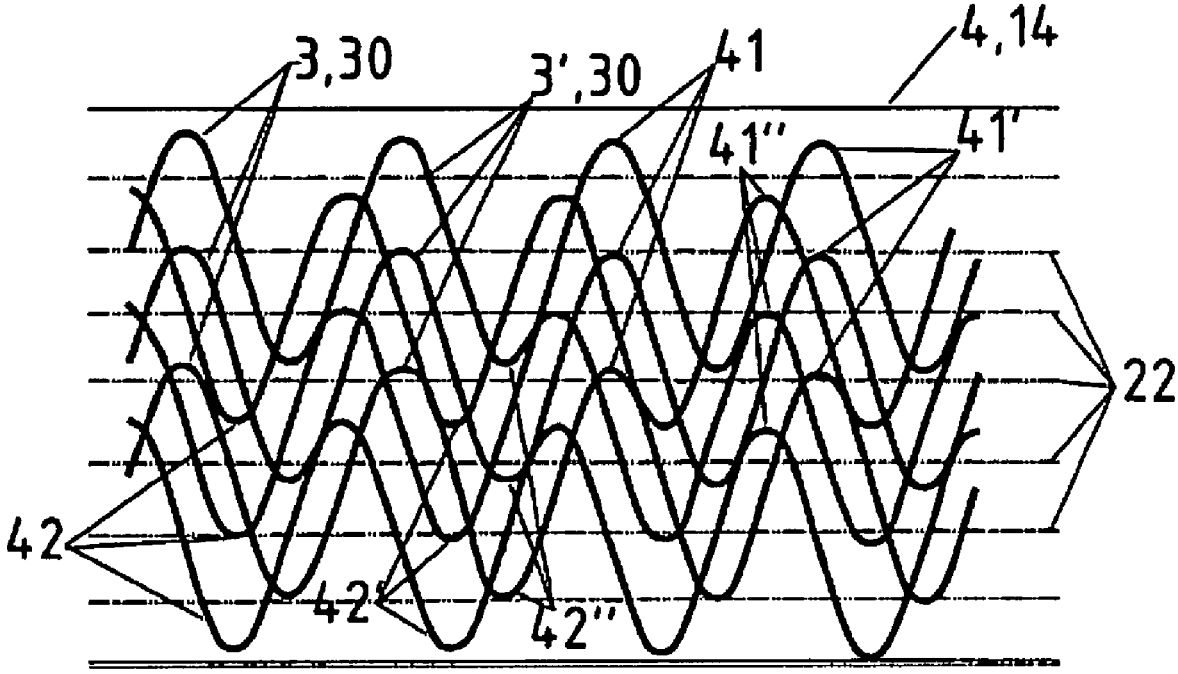
FIG. 4 shows an enlarged top view of a third embodiment of an electrode of the heating element.

In the embodiment according to FIG. 4, two groups of contact conductor strands 3, 3' are provided, as in FIG. 2. The first group has an oscillation contour according to FIG. 2 with varying extreme values. The second group has a sinusoidal oscillation with constant extreme values. In this case, the contact conductor strands 3, 3' are arranged in such a way that both groups of contact conductor strands 3, 3' respectively extend over essentially the entire width of the carrier band 14. In addition, both groups are arranged relative to one another such that the extreme values of one group are never arranged at the same location along the electrode 4 as those of the contact conductor strands 3' of the other group.

In other conceivable variations, several contact conductor strands are arranged adjacent to one another, wherein at least one contact conductor strand extends randomly or has a different period than at least one of the other contact conductor strands. It is essential that at least one contact conductor strand extend, at least locally, in a direction that differs from the direction in which the overall electrode 4 and its carrier band 14 respectively extend.

At least the contact conductor strand 3 can feature, for example, at least one essentially metallic, electrical conductor strand 30, wherein this electrical conductor strand preferably consists of copper or a copper alloy and is at least partly provided with a coating of a nonoxidizing or passivated metal, preferably silver or a silver alloy ("metallic contact conductor"). In the embodiment shown, a silver-coated stranded conductor of copper is provided. This reduces the price of the heating element because conventional metallic stranded conductors can be used for the contact conductors.

At least one contact conductor strand 3 and/or one electrode 4 is electrically connected to a plurality of heating conductors 2. In the embodiment shown, all contact conductor strands 3 contact all heating conductors 2.

The invention furthermore proposes that the heating element 1 feature at least one connecting line 6 for feeding a current from a current source 70 into the heating element 1 via at least one electrode 4 ("connecting line 6").

The heating element furthermore features a temperature sensor 80 that interrupts the current being supplied to the heating element 1 at temperatures between 60° C. and 80° C. ("temperature sensor").

It may be expedient for at least one contact conductor strand 3 to feature a plurality of individual strands, preferably between 1 and 360, particularly between 10 and 70 ("numerous individual strands"). In the embodiment shown, the contact conductor strands 3 are realized with approximately 60 individual strands. This ensures that the contact conductor strand 3 also remains functional if individual strands fail, e.g., during sewing. In this case, a plurality of individual strands are also combined into at least one strand bundle ("strand bundle") in order to increase the stability of the contact conductor strand 3. Several strand bundles, preferably between 1 and 20, particularly between 2 and 5, are then combined into a complete bundle. In this case, 2 strand bundles are provided.

Figure 5:
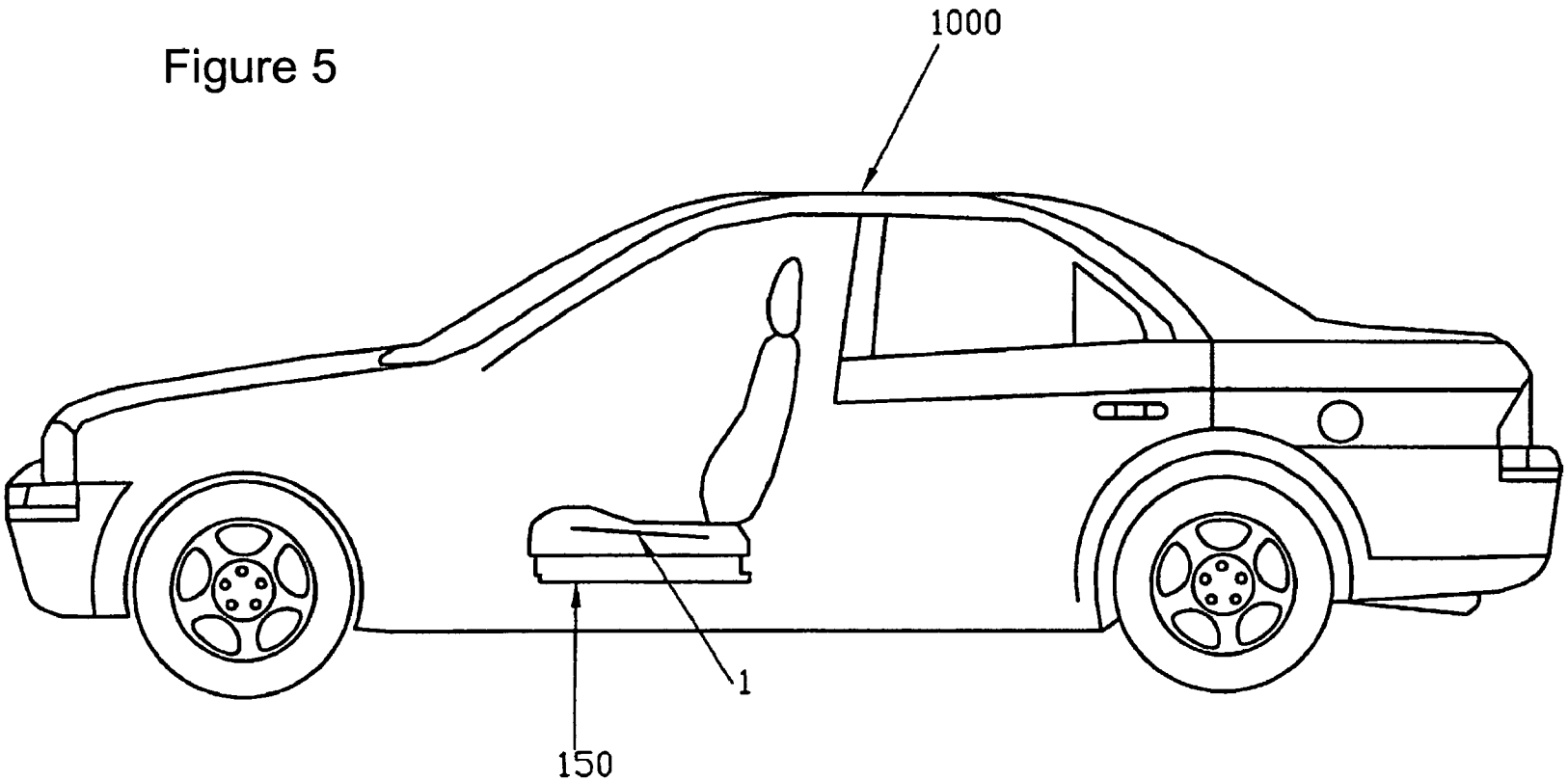
FIG. 5 shows a partially sectioned side view of a vehicle with a heated seat.

It may be expedient to incorporate the heating element into a vehicle seat, a steering wheel, an arm rest, seat padding, a thermal blanket or the like. FIG. 5 shows a heating element that is installed in a seat 150. The heating element can be situated in a seat insert or between the seat cover surface and the seat cushion as shown. It may be expedient to install the heating element into a larger subsystem in order to provide the seat user with heating, cooling, ventilation, etc.

LIST OF REFERENCE SYMBOLS

1 Heating element
2 Heating conductors
3, 3' Contact conductor strands
4 Electrode
8 Carrier
14 Carrier band
18 Heating resistor
22 Line of stitching
30 Metallic conductor strand
41 Maxima
42 Minima
57 Ends of heating conductors
77 Contact points
80 Temperature sensor
100 Heating zone
150 Seat
200 Contacting region

What is claimed is

1. An electric heating element comprising:

a. at least one flat heating resistor for disposed near a surface to be heated; and b. at least one electrode for feeding a current into the flat heating resistor, the at least one electrode comprising at least two contact conductor strands including an elongated contacting region;

wherein, within the elongated contacting region of the electrode feeds a current into the flat heating resistor, wherein the at least two of the contact conductor strands are at least locally in contact to one another and to the heating resistor, and wherein further at least one point at least one of the contact conductor strands at least locally extends directionally generally parallel to the direction of the electrode and at least one other contact conductor strand at least locally extends angular to the direction of the electrode or of the elongated contacting region or both.

2. The electric heating element as in claim 1 wherein at least two contact conductor strands, at least in some sections, extend in a non-linear manner.

3. The electric heating element as in claim 1 wherein at least two contact conductor strands extend in a periodic oscillation fashion with the same oscillation pattern, wherein the individual contact conductor strands are separated by a phase-shift relative to their longitudinal direction.

4. The electric heating element as in claim 1 wherein the at least one of the flat heating resistors is comprised at least partially of an electrically conductive material and at least one of the flat heating resistors comprises at least partially an electrical resistance material or electrically insulating material.

5. The electric heating element as in claim 1 wherein at least one contact conductor strand at least partially is made of a metallic wire.

6. The electric heating element as in claim 1 wherein the electric heating element is contained in a seat.

7. The electric heating element as in claim 1 wherein the at least one electric heating element is in a vehicle.

8. The electric heating element as in claim 4 wherein the electrically conductive material further comprises at least one material selected from the group consisting of carbon fibers, metal foil, metallized, foil and metallized plastic fibers.

9. The electric heating element as in claim 4 wherein the electrically insulating material further comprises at least one material selected from the group consisting of knitted fabric, non-woven fabric, natural fibers and man-made fibers.

10. The electric heating element as in claim 5 wherein the metallic wire further comprises at least one material selected from the group consisting of silver-plated cooper, stainless steel, electrically conductive coated plastic and silver coated plastic.

11. An automotive vehicle having at least one seat that is heated by an electric heating element comprising:

a. a flat carrier;

b. at least one electrode comprising a conductor network arranged on the flat carrier, including at least two contact conductor strand bundles that are generally curved and generally parallel to each another but phase shifted relative to each other such that they contact one another in at least one contact point, such that in the event of local failure, heating current can be distributed to adjacent heating conductors contacting the conductor network; and c. at least one connecting line associated with the carrier for supplying a current from a current source to the conductor network.

12. The vehicle of claim 11, wherein the strand bundles contain between 10 and 70 individual strands.

13. The vehicle of claim 12, wherein the individual strands include a coating of a nonoxidizing or passivated metal.

14. The vehicle of claim 13, wherein the individual strands consist of copper or a copper alloy and is at least partly provided with a coating of silver or a silver alloy.

15. An electric heating element comprising:

a. a non-woven flat carrier;

b. at least one electrode comprising a conductor network stitched on the flat carrier, including at least two contact conductor strand bundles that have a generally sinusoidal contour and generally parallel to each another but phase shifted relative to each other at regular spacings such that they contact one another in at least one contact point, such that in the event of local failure, heating current can be distributed to adjacent heating conductors contacting the conductor network; and c. at least one connecting line associated with the carrier for supplying a current from a current source to the conductor network.

16. The electric heating element of claim 15, wherein the strand bundles contain between 10 and 70 individual strands.

17. The electric heating element of claim 16, wherein the individual strands include a coating of a nonoxidizing or passivated metal.

18. The electric heating element of claim 17, wherein the individual strands consist of copper or a copper alloy and is at least partly provided with a coating of silver or a silver alloy.

* * * * *